US009227706B2

(12) United States Patent
Darroch

(10) Patent No.: US 9,227,706 B2
(45) Date of Patent: Jan. 5, 2016

(54) MARKER AND RECOVERY DEVICE

(76) Inventor: Neil Darroch, Burlington (CA)

( * ) Notice: Subject to any disclaimer, the term of this patent is extended or adjusted under 35 U.S.C. 154(b) by 112 days.

(21) Appl. No.: 14/124,159

(22) PCT Filed: Jun. 6, 2012

(86) PCT No.: PCT/CA2012/050382

§ 371 (c)(1),
(2), (4) Date: Dec. 5, 2013

(87) PCT Pub. No.: WO2012/167379

PCT Pub. Date: Dec. 13, 2012

(65) Prior Publication Data

US 2014/0099846 A1 Apr. 10, 2014

Related U.S. Application Data

(60) Provisional application No. 61/493,734, filed on Jun. 6, 2011.

(51) Int. Cl.

| | |
|---|---|
| ***B63C 9/20*** | (2006.01) |
| ***B63C 9/08*** | (2006.01) |
| ***B63C 9/125*** | (2006.01) |

(52) U.S. Cl.

CPC ..... *B63C 9/081* (2013.01); *B63C 9/1255* (2013.01); *B63C 9/20* (2013.01)

(58) Field of Classification Search

CPC ..... B63C 9/20

See application file for complete search history.

(56) References Cited

U.S. PATENT DOCUMENTS

| | | | | |
|---|---|---|---|---|
| 3,638,258 | A | 2/1972 | Black | |
| 3,877,096 | A | 4/1975 | Scesney | |
| 5,344,351 | A | 9/1994 | Danielson | |
| 5,800,227 | A * | 9/1998 | Brown, Jr. | 441/80 |
| 6,332,424 | B1 | 12/2001 | Frink | |
| 2006/0270290 | A1 * | 11/2006 | Tellew | 441/88 |

FOREIGN PATENT DOCUMENTS

| | | |
|---|---|---|
| JP | 0342799 | 4/1991 |
| WO | 0073143 | 12/2000 |

OTHER PUBLICATIONS

International Search Report for PCT/CA2012/050382, Completed by the Canadian Patent Office on Sep. 17, 2012, 4 Pages.

* cited by examiner

*Primary Examiner* — Edwin Swinehart
(74) *Attorney, Agent, or Firm* — Brooks Kushman P.C.

(57) ABSTRACT

A marker and recovery device has a body for securing to a torso and an arch secured to the body at spaced locations. The arch is extendable from a stored to a deployed condition. In the deployed condition, the arch extends from the torso of the wearer to function as a visible marker. The arch facilitates recovery of the wearer.

13 Claims, 16 Drawing Sheets

MARKER AND RECOVERY DEVICE

CROSS-REFERENCE TO RELATED APPLICATION

This application is the U.S. national phase of PCT Application No. PCT/CA2012/050382 filed on Jun. 6, 2012, which claims the benefit of U.S. Provisional Application No. 61/493,734 filed on Jun. 6, 2011, the disclosures of which are incorporated in their entirety by reference herein.

FIELD OF THE INVENTION

The present invention relates to a personal marker and recovery device for waterborne activities.

DESCRIPTION OF THE PRIOR ART

When engaged in waterborne activities, such as boating, there is a constant risk of unintentionally falling into the water and being separated from the vessel. To mitigate the risk of drowning, personal floatation devices (PFDs), otherwise known as life jackets, are in widespread use and are responsible for saving countless lives from drowning. The PFDs come in many different configurations but essentially all provide a vest-like structure that fits over the upper torso. The vest is secured by a harness, in the simplest form tie straps, so that the vest is retained on the upper torso. The vest is buoyant and is effective to maintain the wearer afloat and face-up in water.

The vest may be naturally buoyant, such as when made with a closed-cell foam, or may be inflatable to achieve the requisite buoyancy. Inflation may come from a small pressurized gas cylinder and/or a manual inflation valve. When properly utilized, the vest is capable of supporting the wearer and maintaining them afloat in a stable condition indefinitely.

However, although the PFD supports the wearer, the prompt recovery of the wearer is important due to the exposure to adverse conditions, such as the water temperature and loss of body heat.

Whilst the vests are made from a high visibility material, such as a day glow orange or other fluorescent material, the rescue of the wearer does depend upon the wearer being visually locatable. In even a relatively small body of calm water, the wearer may not be readily discernable from the general surrounding environment, and, if the wearer is unconscious, is not able to attract attention to rescuers through waving and/or shouting. This problem is exacerbated when there is any degree of wave motion and of course the ability to spot an individual from an aircraft is extremely difficult.

Various proposals have been made to enhance the visibility to facilitate rescue.

U.S. Pat. No. 3,877,096 to Scesney shows an inflatable floatation device that forms a tetrahedron that can be inflated by a person in distress. This does however require the device to be inflated by the user and remain tethered to the user once deployed.

U.S. Pat. No. 5,800,227 shows a PFD with a folded marker device on the back of the PFD. The marker device may be released. This device however is relatively bulky and may create imbalance such that the face of the wearer is in fact held in to the water rather than supported above the water.

U.S. Pat. No. 3,638,258 discloses a PFD in which an elongate bar is attached to the PFD. The bar may be inflated so that a wand is provided that enhances visibility. The wand is intended to be detachable and therefore its position relative to the wearer may vary.

It is object to the present invention to obviate or mitigate the above disadvantages.

SUMMARY OF THE INVENTION

According to the present invention a marker and recovery device includes a body to be secured to the torso of a wearer. An arch is secured to the body at spaced locations. The arch is extendable from a stored condition to a deployed condition in which the arch extends from the torso of the wearer.

Preferably an attachment is provided on the arch approximate the middle of the arch to facilitate rescue of the wearer.

As a further preference, the arch in its flaccid state passes behind the head of the wearer and, upon inflation, moves forward of the head to project normally from the torso of the wearer.

BRIEF DESCRIPTION OF THE DRAWINGS

Embodiments of the invention will now be described by way of example only with reference to the accompanying drawings in which.

DETAILED DESCRIPTION OF THE INVENTION

Figure 1:
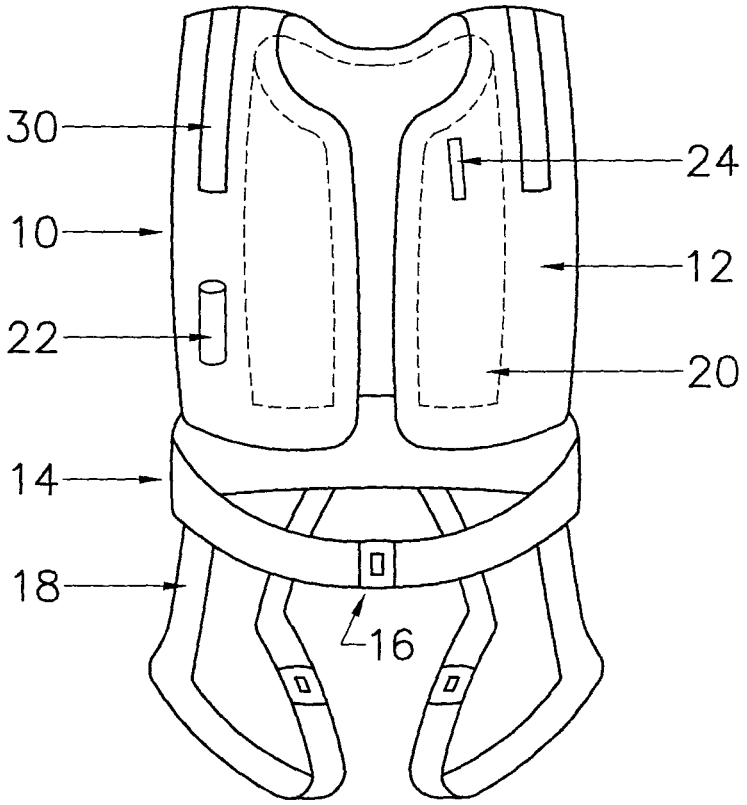
FIG. 1 is a front elevation of a personal flotation device incorporating a marker and recovery device.
Figure 2:
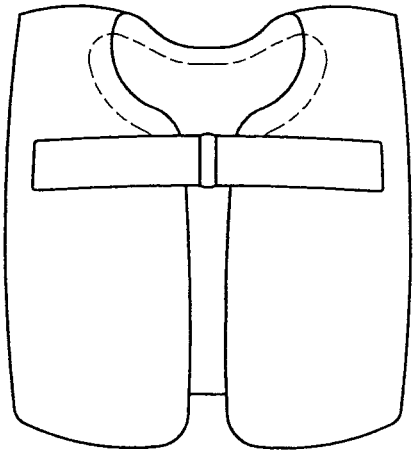
FIG. 2 is a front elevation similar to FIG. 1 showing the personal floatation device in a deployed condition.

Referring therefore to FIG. 1, a marker and recovery device is incorporated in to personal floatation device 10. The device 10 has a body formed as a vest 12 dimensioned to cover the upper torso of a wearer. It will be appreciated that the vest 12 will be sized according to the typical dimensions of a wearer and may take many different forms depending on the intended application and the severity of the environment in which the PFD 10 is to be utilized. In the embodiment illustrated in FIG. 1, the PFD includes a harness generally indicated at 14 with a buckle 16 to secure the harness around the waist of the wearer. Leg loops 18 are also provided to further secure the vest to the user.

Other common personal floatation devices do not utilize the leg loops 18 and the vest 12 may be secured to the torso with simple straps or buckles that pass around the waist of the wearer.

The vest 12 includes a pair of bladders 20 that are sewn into the material of the vest. The bladders 20 are connected to a gas cylinder 22 incorporated into the vest 12. The gas cylinder may be deployed either manually or automatically upon contact with the water to supply pressurized gas into the bladders 20 and inflate the front facing panels of the vest 12. Additionally, a manual valve 24 is incorporated on the vest to allow manual inflation of the bladders in the event that the pressurized canister 22 fails to inflate the bladders adequately.

A marker and recovery device in the form of an elongate arch, generally indicated at 30, is secured at spaced locations to the vest 12. The arch 30 comprises a tubular sleeve of air impermeable material. The opposite ends of the sleeve are secured to the vest, one on each of the front panels 13, and are connected to the pressurized canister 22. The connection to the canister 22 may be through a separate supply line or in directly by connection to the bladder 20. Alternatively, a separate cylinder, indicated in ghosted outline 26, is provided to supply the arch 30 with pressurized gas.

The tubular sleeve 32 is made from a flaccid, impermeable material such as thermoplastic polyurethane (TPU) or PVC coated nylon fabric. In a typical application, the sleeve 32 has an overall length of between 24 and 48 inches and a diameter of between 2 and 4 inches. Enhanced visibility may be obtained by increasing the length of the sleeve and arrangements with an overall length of sleeve of 96" and a diameter of 2" have been found to be viable.

Figure 3:
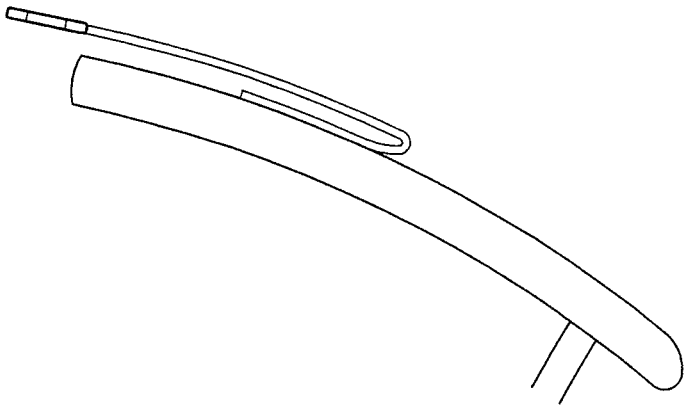
FIG. 3 is a side view of the personal floatation device of FIG. 1.
Figure 4:
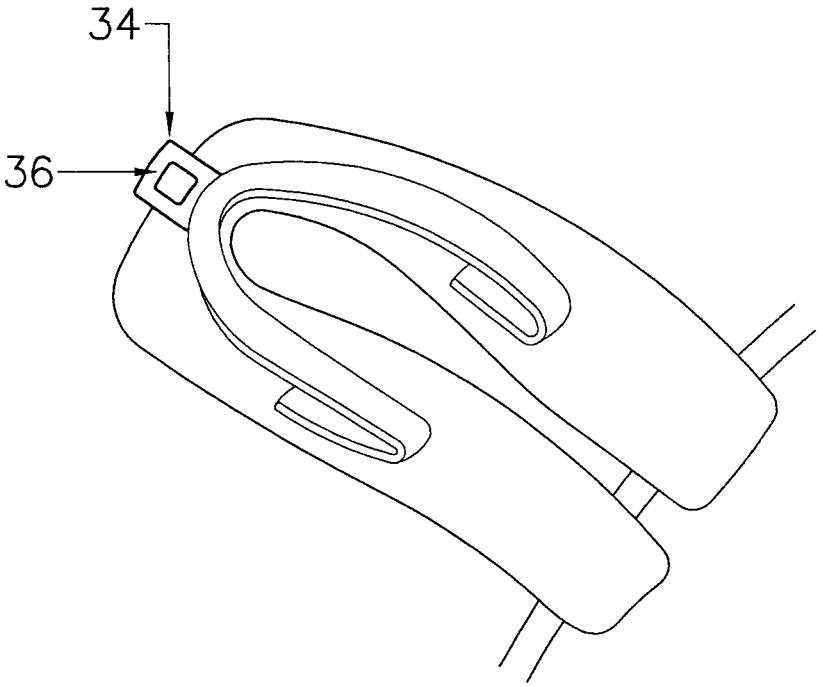
FIG. 4 is a perspective view of a personal floatation device in a uninflated condition.

As can be seen more clearly in FIGS. 3 and 4, the sleeve 32 is located on the front panels 13 and, when stored, is folded back on itself so as to pass behind the head aperture 15 of the vest 12. Although not shown for the sake of clarity, the sleeve 32 is preferably covered by a detachable panel or strap so that it is securely stored when not in use within the body of the vest 12. The detachable panel is a flap of material sewn to the vest 12 with hook and loop fastener, referred to as Velcro, tabs that locate the panel and maintain it in situ.

A tab 34 is secured to the sleeve 32 at its midpoint, which coincides with a central position behind the head of the wearer. The tab 34 has a closed opening 36 that is intended to receive a hook or rope allowing the wearer of the PFD 10 to be lifted readily from the water.

As can be seen from FIGS. 3 and 4, prior to deployment, the sleeve 32 is maintained in a stored condition within the vest 12 and does not interfere with normal operation of the wearer. If however floatation is required from the PFD 10, the pressurized gas 22 is released, causing the bladders 20 to inflate. This may occur prior to immersion in the water or subsequent to immersion in the water depending upon the particular conditions.

Figure 5:
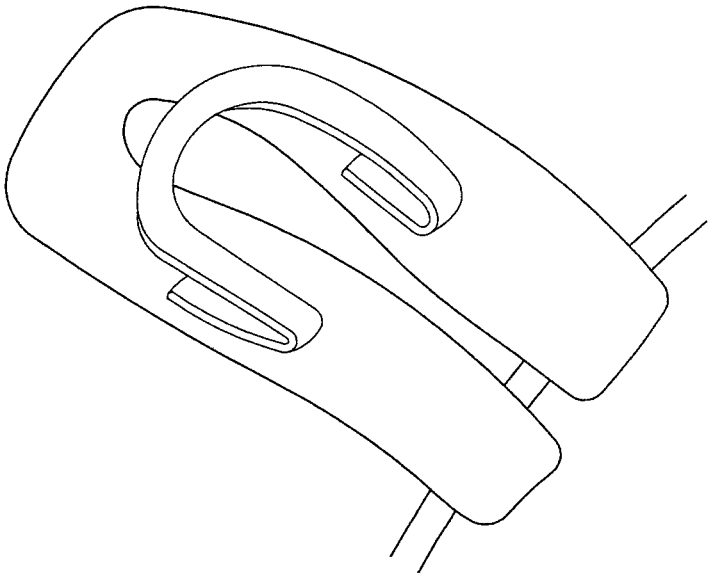
FIG. 5 is a view similar to FIG. 4 showing the personal floatation device in a partially inflated position.
Figure 6:
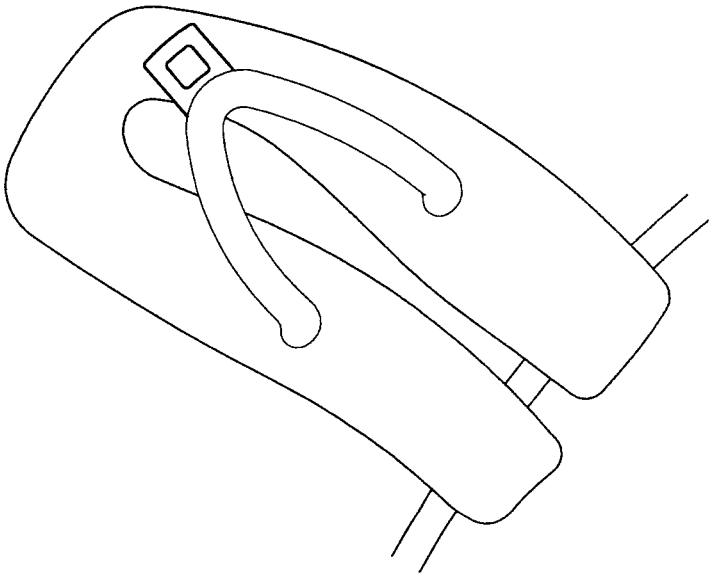
FIG. 6 is a view similar to FIG. 4 showing the personal floatation device in a fully deployed position.
Figure 7:
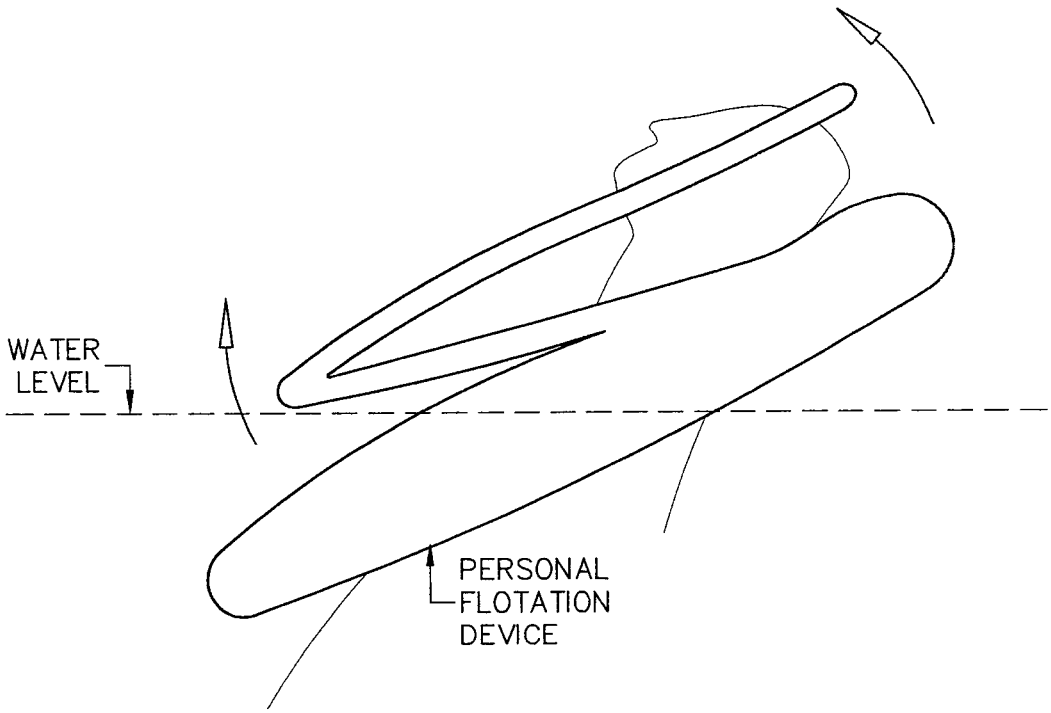
FIG. 7 is a side view of the personal floatation device as deployment is initiated.
Figure 8:
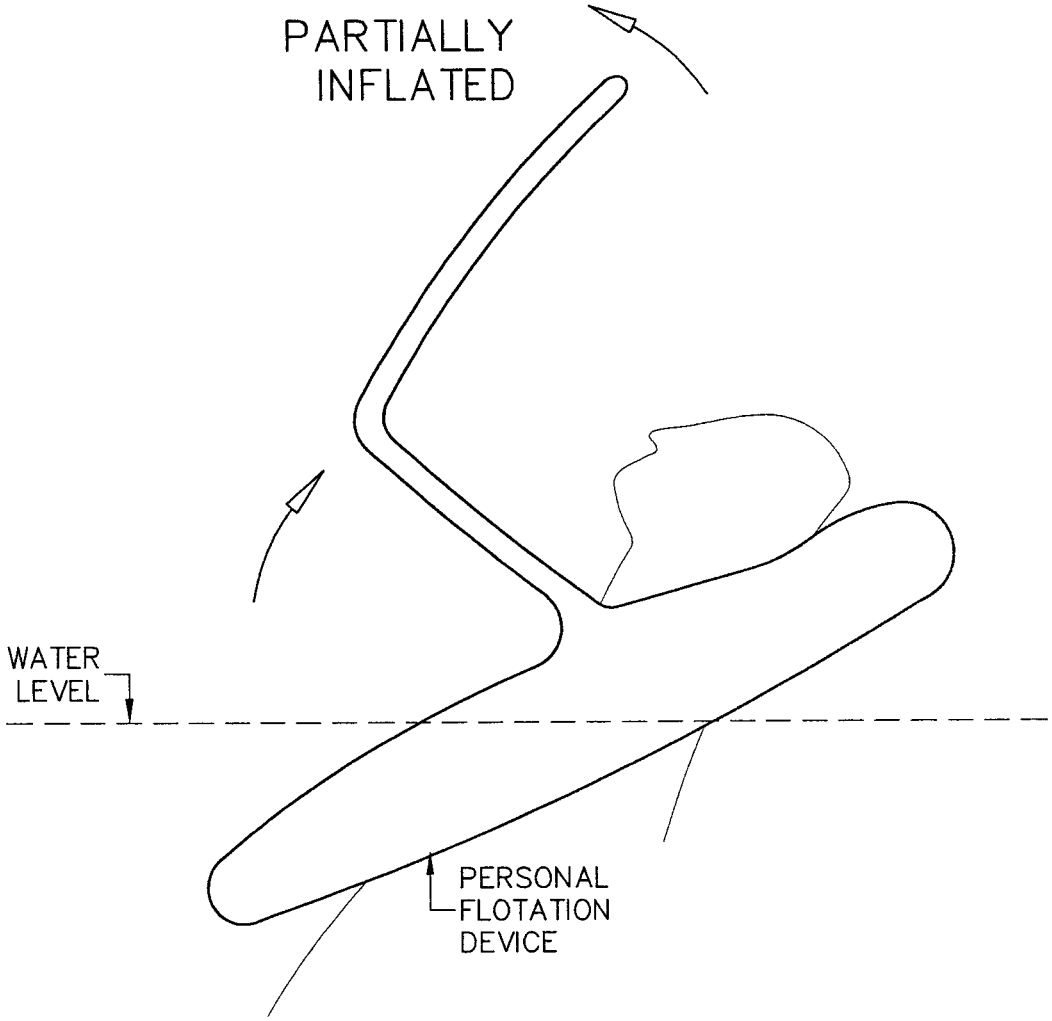
FIG. 8 is a view similar to FIG. 7 showing the personal floatation device partially inflated.
Figure 9:
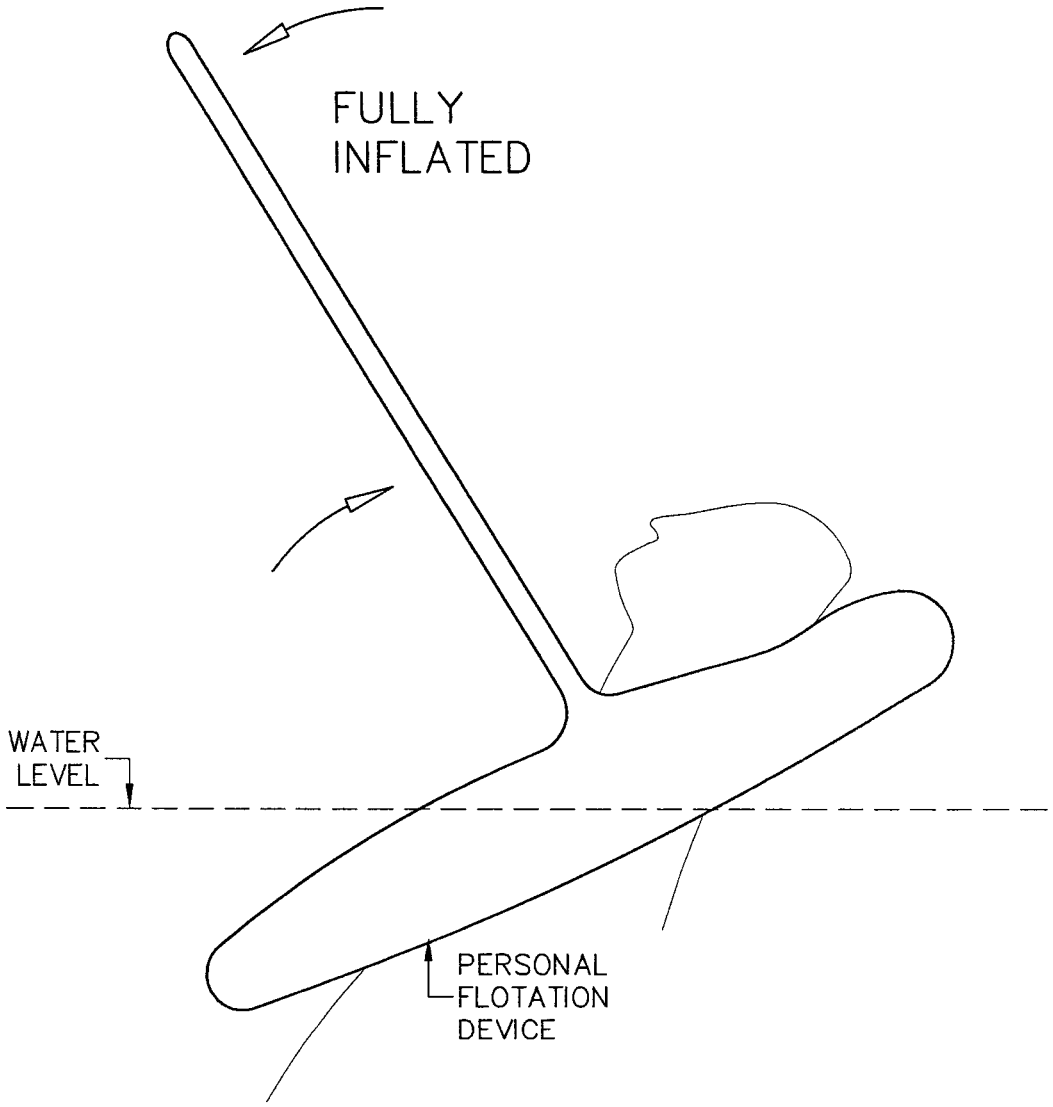
FIG. 9 is a side view similar to FIG. 7 showing the personal floatation device fully inflated.
Figure 10:
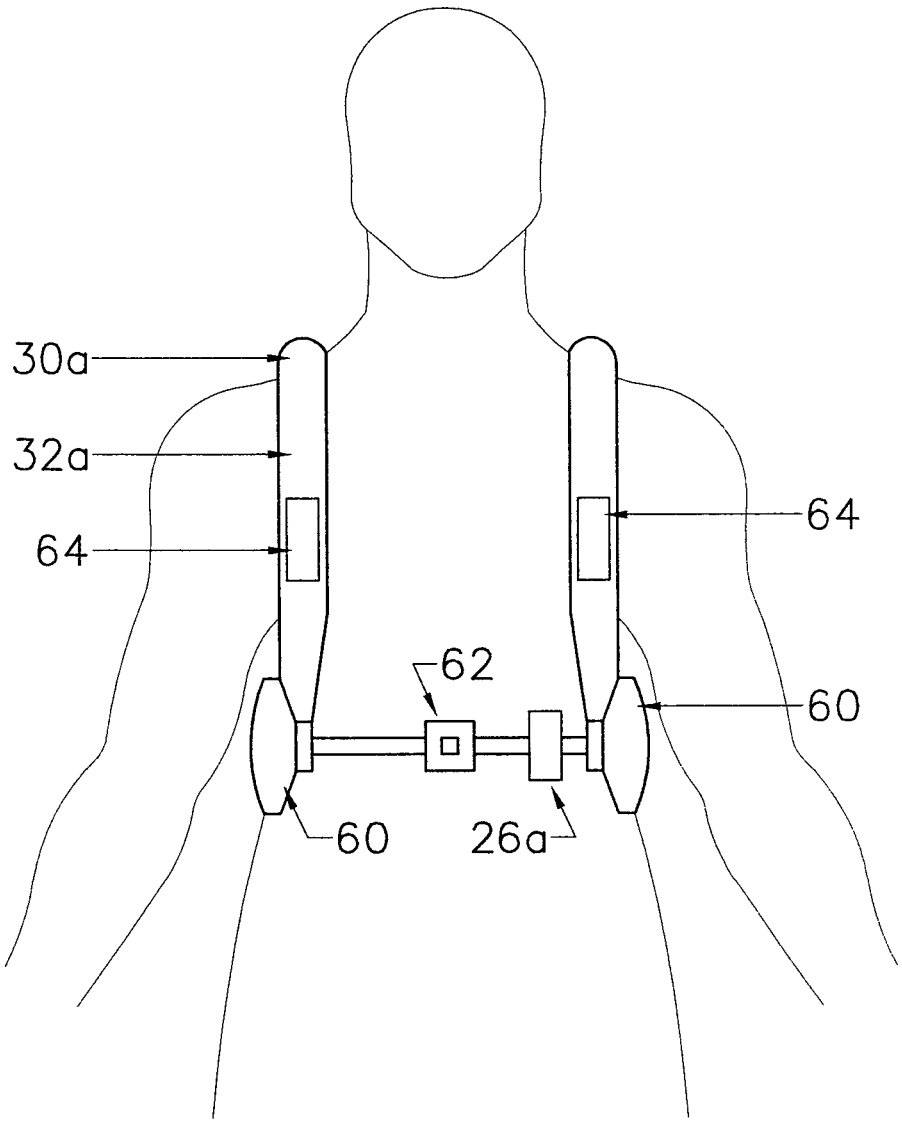
FIG. 10 is a view of an alternative embodiment of a marker and recovery device.
Figure 11:
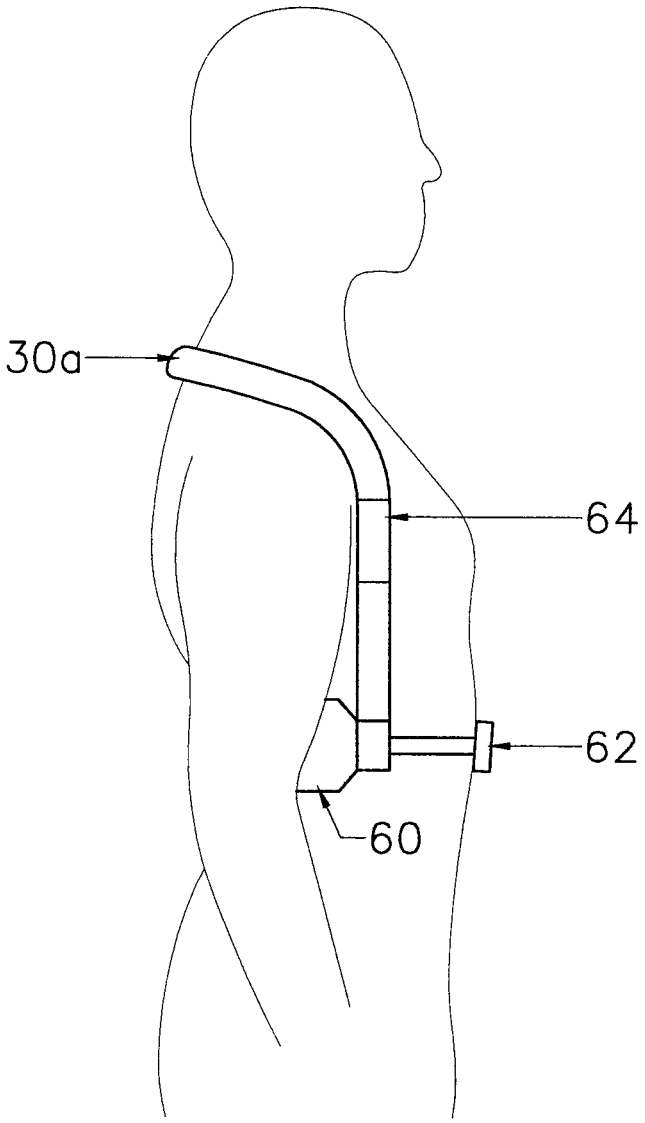
FIG. 11 is a side view of the device of FIG. 10.
Figure 12:
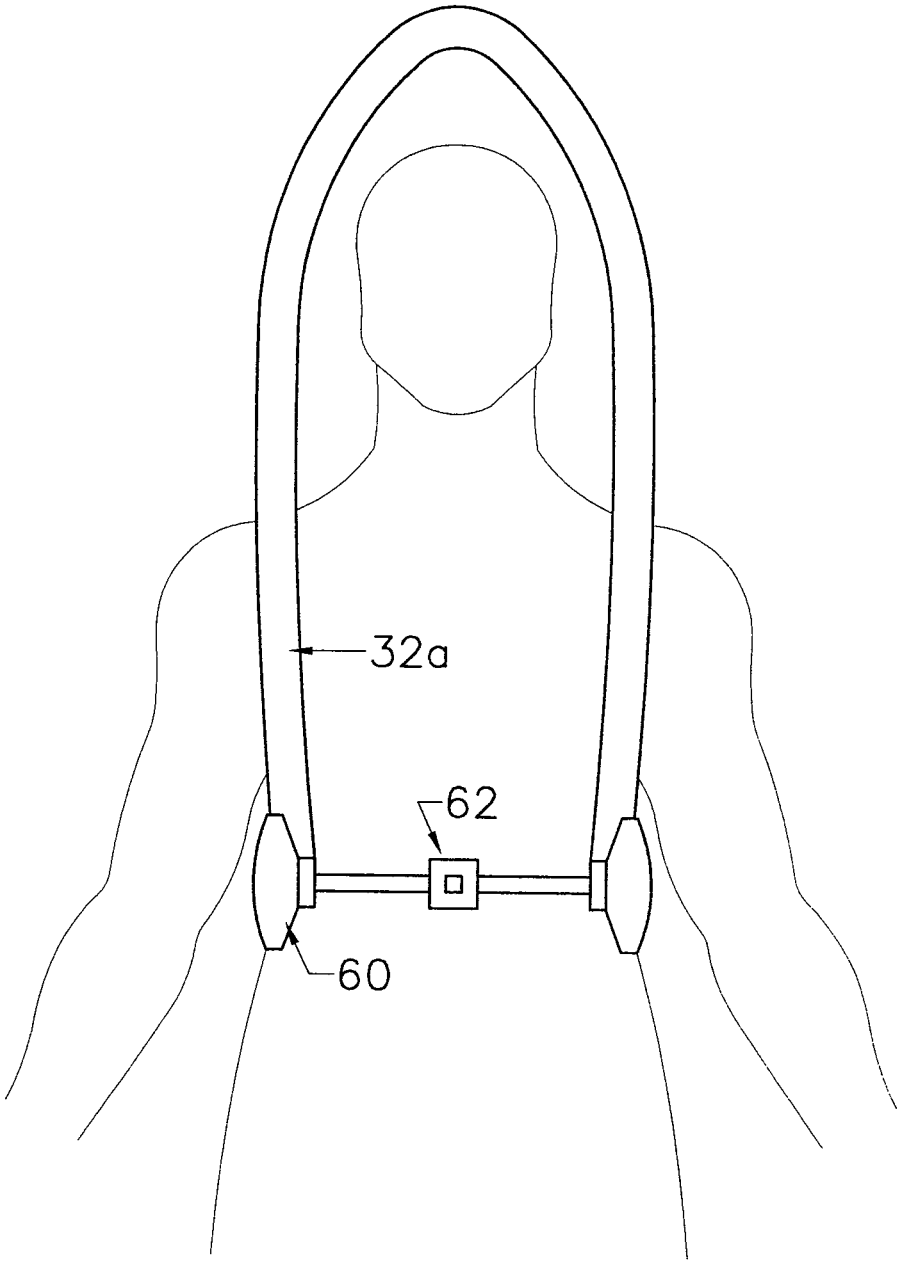
FIG. 12 is a view similar to FIG. 10 with the marker deployed.

Inflation of the bladders 20 supplies pressurized fluid to the interior of the sleeve 32 causing the arch 30 to begin inflation. Referring to FIGS. 5 and 7, initial inflation of the arch 30 causes the covering panel to be released and the midpoint of the arch 30 to move forward from behind the head of the wearer. Continued inflation of the arch 30 moves the arch progressively forward as seen is FIG. 8 until it attains a deployed condition where it is fully pressurized and extends normally from the front panels of the vest 12. If necessary, additional inflation can be provided from the manual inflation 24 to ensure that the arch 30 is fully inflated.

When fully inflated, the vest 12 maintains the wearer face-up in the water. In that position, the arch 30 is projected upwardly and enhances the visibility of the user in the water. With the typical dimensions of the tube, the mid point of the tube is approximately 24 to 48 inches above the torso of the user which facilitates the identification of the user from a distance. It will also be noted that the arch 30 does not interfere with the normal buoyancy and stability provided by the vest 12 and thereby ensures that the wearer is maintained face-upward in the water.

Recovery of the user is facilitated by the provision of the tab 34 which enables the user to be bodily lifted from the water. The tab 34 may be located by a boat hook and a rope attached to the islet 36. Thereafter the wearer may be hoisted from the water and secured on board the rescue vessel.

Deflation of the vest 12 similarly causes deflation of the arch 30 allowing it to be restored for reuse with the vest 12.

Various alternative arrangements may be utilized with the vest 12. The arch 30 may be formed as two separate chambers connected at the tab 34 and inflated separately by the bladders 20. As noted above, the sleeve 32 may be inflated by a separate gas supply. The arch 30 may be incorporated in naturally buoyant PFDs in which case the canister 22 is provided simply to inflate the sleeve 32. If necessary, a passive inflation device, such as a foam rubber, coil spring or mechanical linkage could be utilized, but a gas inflation device is preferred.

The sleeve 32 may be made to be detachable by providing releasable connectors, such as a zipper, between the sleeve and vest. In this way an existing PFD may be retrofitted with the arch 30, or the arch 30 replaced if necessary.

An alternative embodiment that may be utilized in combination with an existing PFD, or on its own where enhanced buoyancy is not required, is shown in FIGS. 10 through 13. Like reference numerals will be used to identify like components with a suffix 'a' added for clarity.

In the embodiment of FIGS. 10 through 13, the arch 30*a* similar in construction to that described above with respect to FIGS. 1 through 9, is secured to a belt 60 that passes about the torso of the wearer. The belt 60 is secured about the torso by a buckle 62, which is adjustable to provide a snug fit about the torso. The belt 60 may be buoyant to provide some enhanced buoyancy for the wearer, or may be a simple fabric belt when intended for use with an existing PFD.

Figure 13:
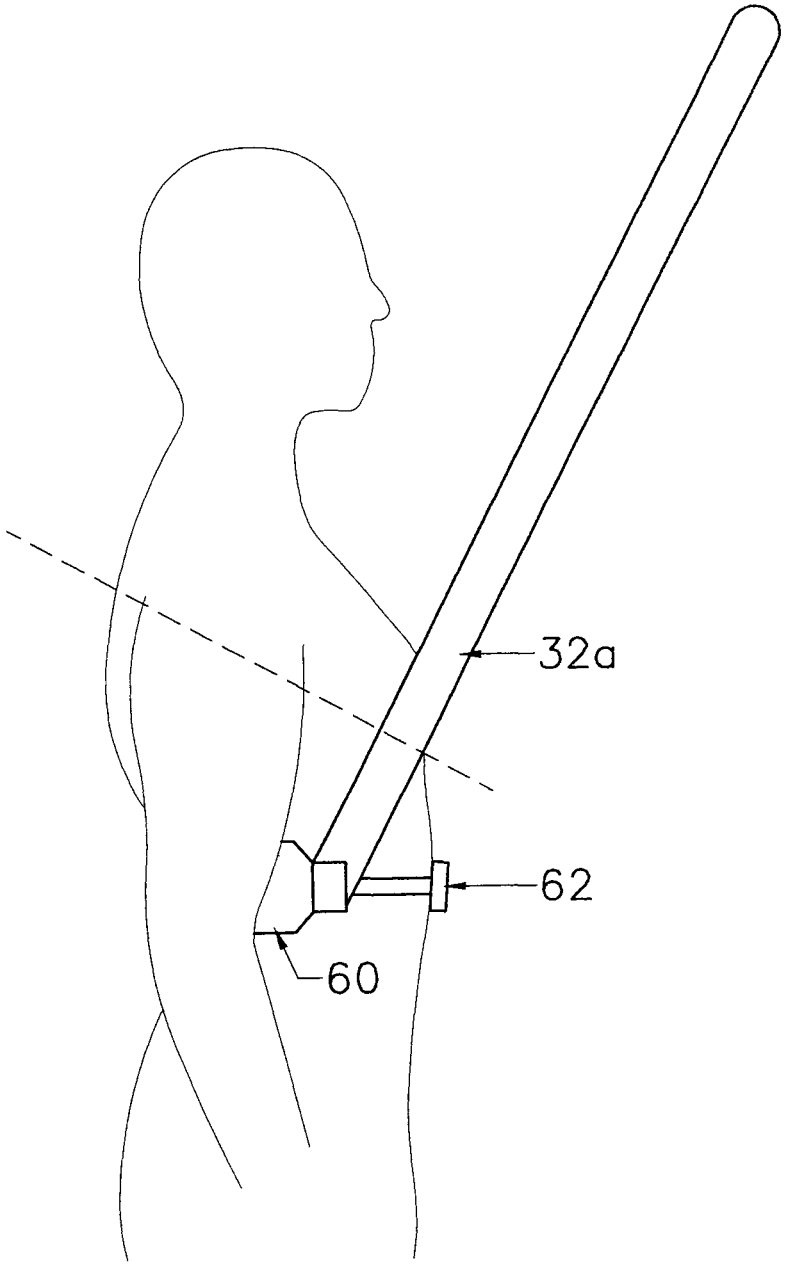
FIG. 13 is a side view of the embodiment of FIG. 12.

The arch 30*a* is formed from the tubular sleeve 32*a* which, as described above, is folded back upon itself and passes behind the head of the wearer. Releasable straps 64 hold the sleeve 32*a* in place until inflated. The spaced locations at which the arch 30*a* is secured to the belt 60 are forward of the arms of the user so that inflation in of the arch 30*a* extends the arch and allows it to move forward to a position in advance of the torso. The disposition of the arch 30*a* when deployed, as shown in FIG. 13, is generally normal to the surface of the water in which the wearer is immersed and so projects upwardly from the water.

Figure 14:
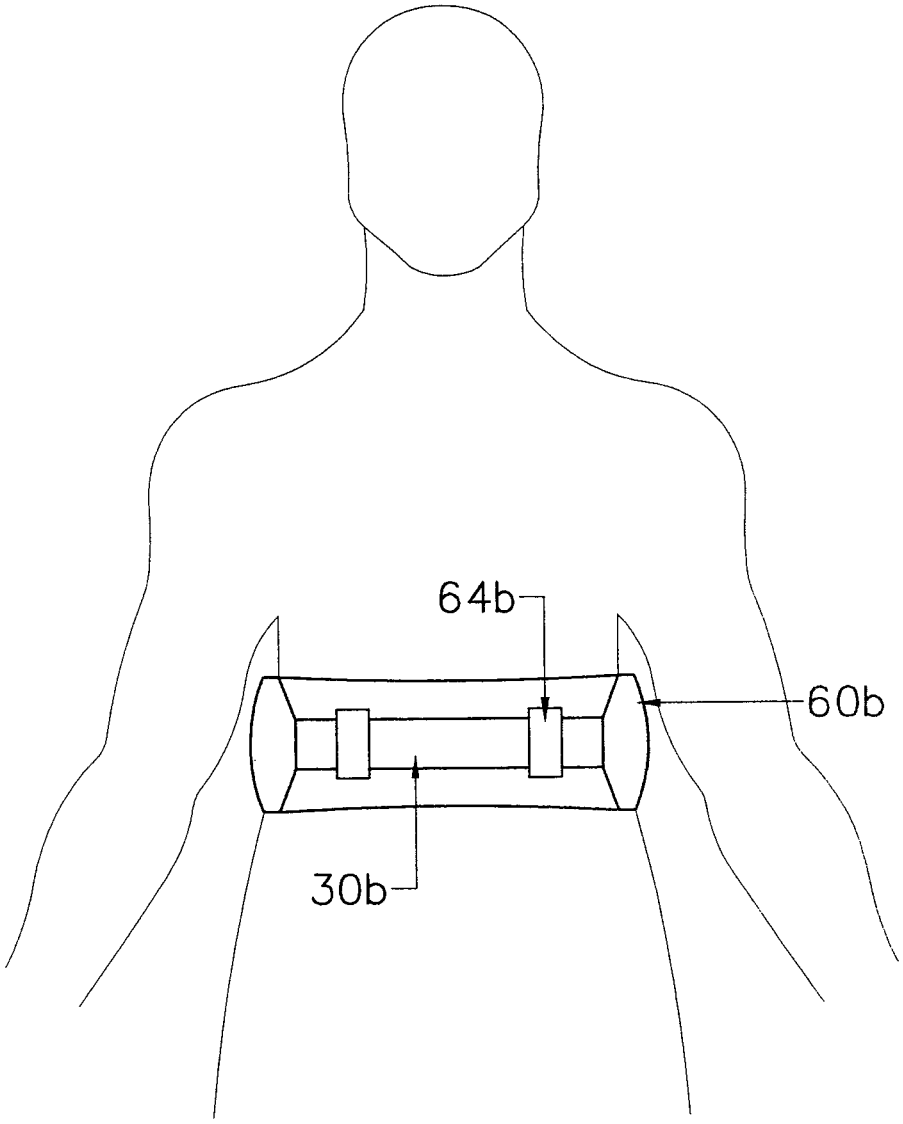
FIG. 14 is a view similar to FIG. 10 of a further alternative embodiment.
Figure 15:
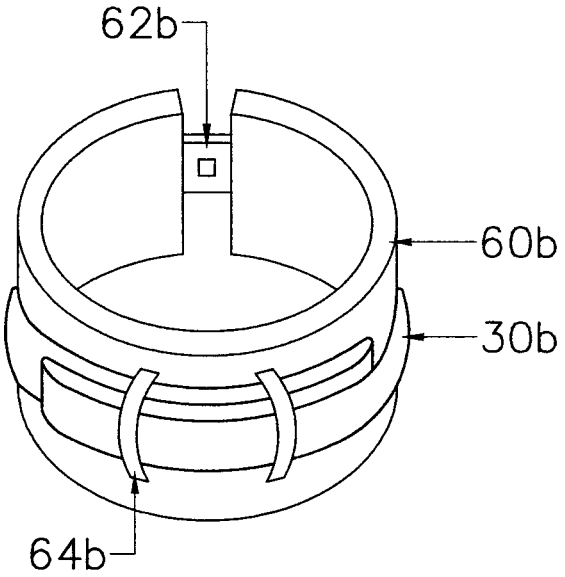
FIG. 15 is a plan view of the embodiment of FIG. 14.
Figure 16:
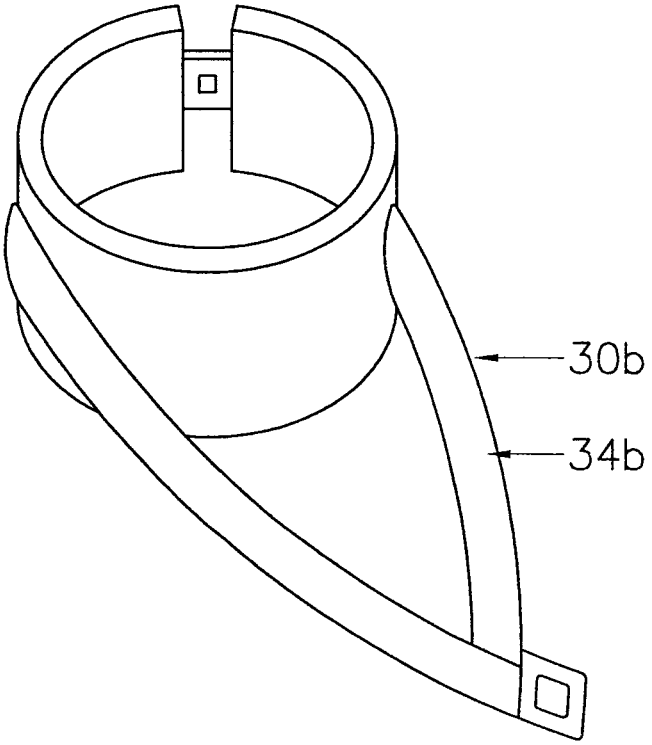
FIG. 16 is a plan view similar to FIG. 14 with the marker deployed.

A further embodiment is shown in FIGS. 14 through 16 in which like components will be identified with a like reference numeral with a suffix 'b' for clarity. In the embodiment of FIGS. 14 through 16, a belt 60*b* is utilized, either buoyant or not, and the arch 30*b* is secured at spaced locations along the belt. A buckle 62*b* is provided but located at the rear of the wearer. The arch 30*b* is formed from a tube 34*b*, as described above, which is folded back on itself along the body of the belt 60*b*. A detachable flap or strap 64*b* secures the tube in 34*b* the folded condition so as to be constrained within the general envelope provided by the belt.

A canister for inflating the tube 34*b* is secured to the belt as indicated at 26*b* and upon inflation causes the arch to project forwardly of the wearer. The arrangement shown in FIGS. 14 through 16 may be combined with a PFD to provide a marker and recovery device in addition to the buoyancy provided with the PFD.

It will also be appreciated that various fastening devices may be provided for the vest 12 and that ancillary equipment such as whistles and flashlights may be incorporated into the vest 12 as is conventional.

The invention claimed is:

1. A marker and recovery device comprising:

a body to be secured to the torso of a wearer, said body having front portions to overlie the front of the torso; and an arch having two ends secured to the body front portions at spaced apart locations, said arch being extendable from a compact stored condition adjacent the body to a deployed condition in which said arch projects from said spaced apart locations at an angle outwardly from said body front portions to extend forward of the torso of the wearer.

2. The device according to claim 1 wherein said arch is inflatable to move between said stored condition and said deployed condition.

3. The device according to claim 1 wherein said arch, in said stored condition, is folded back on itself to provide a close fit to the torso of a wearer.

4. The device according to claim 1 wherein said arch, in its stored condition, is arranged to pass behind a head of a wearer and, upon deployment, moves forward of said head to the deployed condition.

5. The device according to claim 1 wherein said body comprises a vest of a personal floatation device and said arch is secured to said vest at said spaced apart locations.

6. The device of claim 5 wherein said arch is maintained in said stored condition by detachable panels.

7. The device according to claim 1 wherein said arch is formed by a tubular sleeve.

8. The device according to claim 7 wherein said sleeve is inflatable to attain said deployed condition.

9. The device according to claim 8 wherein said sleeve is formed from a flaccid, impermeable material.

10. The device according to claim 9 wherein said material is a thermoplastic polyurethane or PVC coated nylon fabric.

11. The device of claim 8 wherein said sleeve is inflated by a pressurized gas canister secured to said body.

12. The device of claim 1 wherein said body comprises a belt secured about the torso of a wearer.

13. The device of claim 12 wherein said belt is secured by a fastening.

* * * * *